United States Patent [19]

Berry, Jr.

[11] 4,232,825

[45] Nov. 11, 1980

[54] SAFETY FOUNTAIN HEAD

[76] Inventor: Richard L. Berry, Jr., 178 Roycroft Ave., Long Beach, Calif. 90803

[21] Appl. No.: 24,886

[22] Filed: Mar. 29, 1979

[51] Int. Cl.[3] ..... E03B 9/20

[52] U.S. Cl. ..... 239/28; 239/288.5; 239/428.5; D23/34

[58] Field of Search ..... 239/28–32, 239/288, 288.3, 288.5, 428.5, 591, 602; D23/34, 35, 36

[56] References Cited

U.S. PATENT DOCUMENTS

| | | | |
|---|---|---|---|
| D. 217,305 | 4/1970 | Turner | D23/34 |
| 685,675 | 10/1901 | Dewar | 239/32 |
| 1,171,517 | 2/1916 | Haws | 239/29 |
| 2,030,289 | 2/1936 | Haws | 239/31 |
| 2,253,600 | 8/1941 | Arneson | 239/31 |
| 3,129,894 | 4/1964 | Schermerhorn | 239/602 |
| 3,286,931 | 11/1966 | Webb | 239/602 |

FOREIGN PATENT DOCUMENTS

| | | | |
|---|---|---|---|
| 394540 | 6/1933 | United Kingdom | 239/32 |

*Primary Examiner*—Robert B. Reeves
*Assistant Examiner*—Michael J. Forman
*Attorney, Agent, or Firm*—Fulwider, Patton, Rieber, Lee & Utecht

[57] ABSTRACT

There is disclosed a safety fountain head for drinking fountains, bubblers, and the like, which comprises a body that is formed of a resilient, impact-absorbing plastic having a bulbous shape and a dependent neck which receives a tubular metal sleeve member that distally bears means for attachment of the head to a conduit and which terminates within the body as a tubular member having a leg portion angularly disposed to the sleeve. The body has a discharge port which communicates with the open end of the leg portion and also has a drain and aeration passageway which communicates from an undersurface of the body to a drain and aeration port in the sleeve member. The sleeve member is metallic and is embedded within the plastic body which is molded to the sleeve member during its manufacture. The sleeve member has a peripheral rib to enhance its retention within the molded-on plastic body.

1 Claim, 6 Drawing Figures

SAFETY FOUNTAIN HEAD

BACKGROUND OF THE INVENTION

This invention relates to an aeration nozzle and in particular to an aeration nozzle for use on a drinking fountain.

The common aeration nozzle used on drinking fountains and bubblers is metallic and presents a significant hazard to users, particularly children. Substantial injury can occur when one falls or is pushed, impacting the metal fountain nozzle, since the impact can result in breaking or chipping one's teeth and cutting and bruising one's mouth and face. Despite this hazard, there have been no significant replacements or substitutes for the ubiquitous metallic bubbler.

In U.S. Pat. No. 2,253,600, there is disclosed a covering formed of rubber and the like to be placed over a non-aerating nozzle to provide protection to users. The cover has small diameter apertures for discharge of water which, it is disclosed, expands the covering, presumably forming a protective cushion between the underlying hard metal fountain head and the cover. This structure will not provide adequate impact absorption and, furthermore, is non-hygenic since there is inadequate provision for draining of water which can be trapped between the cover and the metallic fountain head. The same patent also discloses a hollow-form bulbous head formed of plastic. The structure, however, does not provide for dispensing of an aerated stream of water and, furthermore, a hollow-form structure does not provide adequate impact absorbing property.

BRIEF DESCRIPTION OF THE INVENTION

This invention comprises a bubbler head for drinking fountains and the like which comprises a solid-form body of a resilient, impact-absorbing plastic having a bulbous shape and a reduced diameter neck with a tubular, open-ended metal sleeve that is coaxially received in the neck, extending into and terminating within the body, and having conduit attachment means such as internal threads for securing the head to a conduit. The body has a discharge port in a side wall with a short passageway communicating to the sleeve member and one or more drain and aeration passageways which extend from an underside of the body into communication with aligned, drain and aeration ports of the sleeve member. The sleeve member is embedded in the plastic body by molding therein during the fabrication of the body. Preferably, the tubular metal sleeve has an inclined leg portion received within the body and has one or more raised ribs which enhance its retention within the body.

DESCRIPTION OF THE DRAWINGS

The invention will be described with reference to the figures of which.

DESCRIPTION OF PREFERRED EMBODIMENTS

Figure 1:
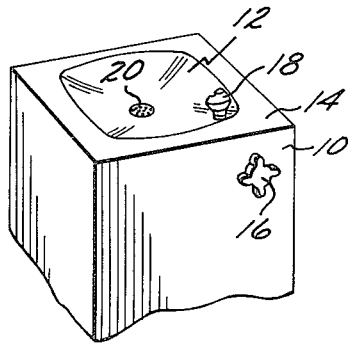
FIG. 1 illustrates a fountain having the fountain head of the invention.

Referring now to FIG. 1, there is illustrated a drinking fountain formed of a housing 10 with a basin 12 in its top surface 14. The fountain is provided, as in conventional construction with a hand valve operator 16 for discharging water through the fountain head 18 which has the construction of the invention. The basin is provided with a drain 20.

Figure 2:
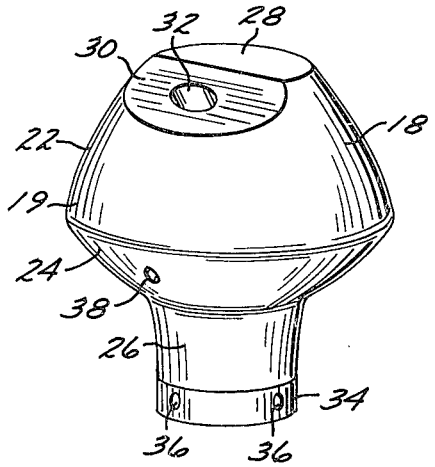
FIG. 2 is a perspective view of the fountain head of the invention.

Referring now to FIG. 2, the fountain head 18 is illustrated in perspective view. The fountain head has a body 19 of a bulbous shape which is generally ellipsoidal, however, more precisely, is defined by the intersection of inverted, conical shapes, the uppermost forming the upper sidewall 22 and the lowermost defining the lower sidewall 24. The sidewalls are slightly convex, of a compound curvature, as illustrated. The lower side wall or undersurface sidewall 24 centrally bears a downwardly dependent neck portion 26 and the upper sidewall conical shape is truncated at 28 to provide a flat top. A concave groove 30 is formed along the edge between the upper sidewall 22 and top wall 28 and the discharge port 32 is centrally located in groove 30.

The neck portion 26 supports an annular metallic flange 34 which has a plurality of apertures 36 for receiving the pin of a spanner wrench, and the like, for attachment and removal of the fountain head.

Figure 3:
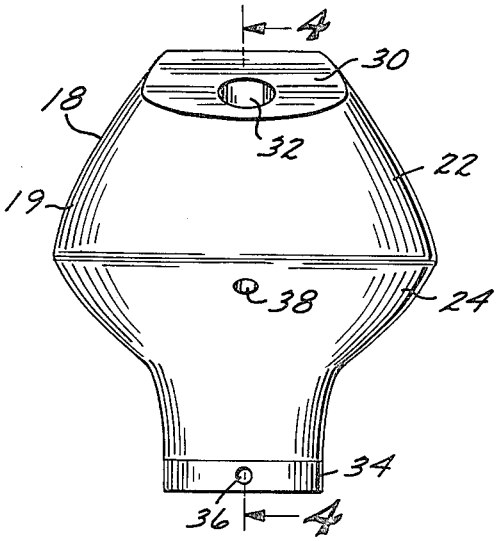
FIG. 3 is an elevational frontal view of the fountain head of the invention.

Referring now to FIG. 3, the fountain head can be seen in elevational view with the discharge port 32 and with a drain and aeration passageway 38 that extends from the undersurface 24 of body 19.

Figure 4:
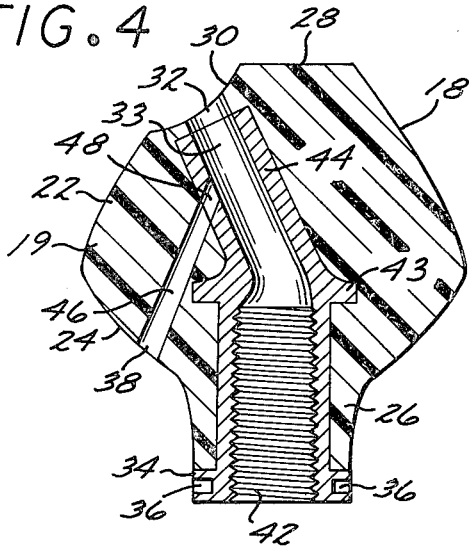
FIG. 4 is an elevational cross-sectional view of the fountain head of the invention.

FIG. 4 illustrates the construction in greater detail. The neck portion 26 of body 19 coaxially receives a metallic sleeve member 40 which has annular flange 34 that is flush with the outer surface of neck 26. The metal sleeve distally carries conduit attachment means in the form of internal threads 42 to permit its removeable attachment to a conventional threaded conduit. Preferably, the sleeve 40 also has one or more rib means to enhance retention of the metal sleeve in the plastic body 19. In the illustrated embodiment, a peripheral rib 43 is provided at an intermediate point of sleeve 40 so that the rib is completely embedded in the plastic body 19 that is molded about the sleeve 40.

The illustrated embodiment also has an inclined tubular leg portion 44. The axis of this tubular portion is inclined to the axis of the main sleeve portion at an angle from about 15 to about 35 degrees and is entirely received within body 19, in which it terminates, directed toward the concave groove 30 and central aperture 32. The sleeve member 40 is open ended and the discharge port 32 of body 19 is in open communication with the open end of leg portion 44 to permit discharge of water from the fountain head.

One or more aeration and drain passageways such as shown at 46 are provided in the body 19. The passageway communicates from the undersurface 24 of body 19 into open communication with a drain and aeration port 48 of sleeve 40. In the preferred, illustrated embodiment, a single passageway 46 communicates with a single aperture 48 which is located intermediate the length of the inclined leg portion 44 of the metallic sleeve 40. Preferably, passageway 46 is flared outwardly, i.e., with an increasing diameter, in a downward direction to prevent any material from obstructing the passageway.

Figure 5:
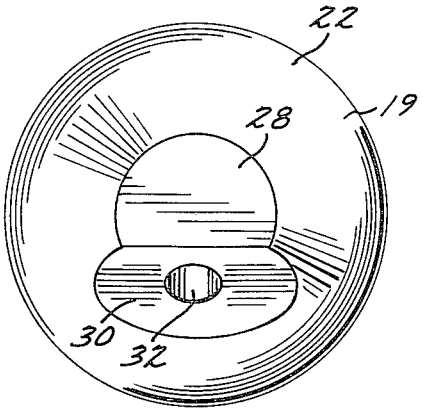
FIG. 5 is a top view of the fountain head of the invention.
Figure 6:
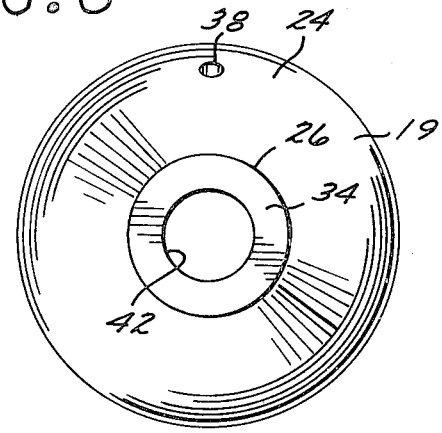
FIG. 6 is a view of the underside of the fountain head of the invention.

The upper surface of the fountain head as shown in FIG. 5 is smooth and devoid of any recesses or wells that could fill with water and be a source of microbial growth. The top surface 22 is smooth and unbroken except for the concave groove 30 and the discharge aperture 32. Similarly, the undersurface, shown in FIG. 6, is unbroken, as shown at 24 and this surface smoothly blends into the neck section 26 with its received metal sleeve and dependent flange 34. In no instance is there any possibility for retention of water by the structure.

The fountain head of the invention is formed of a resilient, impact absorbing plastic such as polyurethane, polyvinyl chloride, natural rubber, synthetic rubber such as polybutadiene, polyacrylonitrile, copolymers of acrylonitrile, butadiene and styrene, and the like. The metal sleeve 40 is molded into the plastic body during fabrication and the passageways such as 46 and 32 can be formed during the molding by inserting a suitable mandrel or pin into the respective apertures 48 and 33 of the insert 40. The mandrels can be tapered slightly to facilitate their removal, resulting in a slightly tapered configuration to these passageways. The aforementioned plastic materials readily bond to the embedded metal sleeve and result in a construction in which the plastic body 19 can not be readily removed from the sleeve insert 40.

The fountain head of the invention is safe and can receive repeated impacts without damage and without inflicting any injury to the face, mouth or teeth of users. The fountain head is tamperproof since it can be secured to the conduit and piping of the fountain with a special tool such as a spanner wrench and this attachment can be enhanced by use of suitable pipe joint or bonding agents that can be applied to the internal threads 42 prior to installation of the fountain head. The fountain head is of inexpensive manufacture and can be fitted onto existing fountains without any modification or alterations of such fountains since it is entirely interchangeable with the fountain heads that are commonly used to discharge aerated streams of water.

The invention has been described with reference to the illustrated and presently preferred embodiments. It is not intended that the invention be unduly limited by this disclosure of preferred embodiments. Instead, it is intended that the invention be defined by the means, and their obvious equivalents, set forth in the following claims.

I claim:

1. A fountain head for a drinking fountain which comprises:

a solid form body molded of a resilient, impact-absorbing plastic having a bulbous shape with a reduced diameter neck, and having a concave groove along the upper edge of a sidewall;

a vertical tubular, open-ended metal sleeve coaxially received in said neck, extending into and terminating within said body, said sleeve having an axially inclined leg portion in alignment with said groove;

conduit attachment means distally carried on the lower end of said sleeve;

a downwardly-facing drain and aeration port in the leg portion of said metal sleeve;

a discharge port coaxial with the groove of said sidewall of said body in open communication with the upper end of said metal sleeve and spaced above the upper end of said sleeve;

a drain and aeration passageway extending downwardly and sidewardly through said body, the upper end of said passageway facing said drain and aeration port of said metal sleeve, and said passageway being flared outwardly and downwardly to prevent material from obstructing said passageway; and the intermediate portion of said metal sleeve having a rib received within and molded into said body.

* * * * *